US009908130B2

(12) United States Patent
Moretti

(10) Patent No.: US 9,908,130 B2
(45) Date of Patent: Mar. 6, 2018

(54) DEVICE TO CONTAIN AND DISPENSE FLUID SUBSTANCES

(71) Applicant: LUMSON S.P.A., Capergnanica (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 159 days.

(21) Appl. No.: 14/757,457

(22) Filed: Dec. 23, 2015

(65) Prior Publication Data

US 2016/0184849 A1 Jun. 30, 2016

(30) Foreign Application Priority Data

Dec. 24, 2014 (IT) ..... M12014A2248

(51) Int. Cl.
*B05B 11/00* (2006.01)

(52) U.S. Cl.
CPC ..... *B05B 11/3045* (2013.01); *B05B 11/0037* (2013.01); *B05B 11/0043* (2013.01); *B05B 11/3043* (2013.01); *B05B 11/3047* (2013.01); *B05B 11/3052* (2013.01); *B05B 11/30* (2013.01)

(58) Field of Classification Search
CPC ..... B05B 11/3045; B05B 11/0037; B05B 11/3043; B05B 11/3052; B05B 11/3047; B05B 11/0043; B05B 11/30
USPC ..... 222/105, 321.9, 321.7
See application file for complete search history.

(56) References Cited

U.S. PATENT DOCUMENTS 5,642,838 A 7/1997 Stoody
2004/0112921 A1 6/2004 Nomoto et al.
2005/0029291 A1* 2/2005 Arghyris ..... B05B 11/0043 222/94

(Continued)

FOREIGN PATENT DOCUMENTS

EP 2243557 A1 10/2010
EP 2279800 A1 2/2011

(Continued)

OTHER PUBLICATIONS

Italian Search Report and Written Opinion dated Sep. 8, 2015 for Italian patent application No. MI2014A002248.

*Primary Examiner* — Paul R Durand
*Assistant Examiner* — Robert Nichols, II
(74) *Attorney, Agent, or Firm* — Vorys, Sater, Seymour and Pease LLP

(57) ABSTRACT

Device to contain and dispense fluid, including: container including neck, connector with ring cap element; deformable bag, for housing inside a container cavity and including neck having opening to access bag cavity, and bag flange extending transversally to the bag neck; manual pump at least partially in the bag neck; ring cap element connected to container neck for connecting pump and bag to container neck; an annular support element for resting on a container neck free edge, annular support element including: seat including rest wall for bag neck flange, ring cap element, when connected to container neck, binding annular support element and at least one flange portion and annular element to container neck; and connector for cooperating with connection counter-part in ring cap element. Ring cap element includes connection counter-part for cooperating with container neck connector for removably connecting ring cap and container neck.

17 Claims, 13 Drawing Sheets

(56) References Cited

U.S. PATENT DOCUMENTS

| | | | | |
|---|---|---|---|---|
| 2011/0024452 | A1* | 2/2011 | Moretti | B05B 11/0043 222/105 |
| 2016/0184850 | A1* | 6/2016 | Moretti | B05B 11/0037 222/95 |

FOREIGN PATENT DOCUMENTS

| | | | |
|---|---|---|---|
| FR | 2757786 | A1 | 7/1998 |
| JP | 05031790 | A | 2/1993 |
| JP | 05031791 | A | 2/1993 |

* cited by examiner

DEVICE TO CONTAIN AND DISPENSE FLUID SUBSTANCES

This claims the benefit of Italian patent application no. MI2014A002248, filed Dec. 24, 2014, incorporated herein by reference.

The present invention refers to a device to contain and dispense, through a pump which can be operated manually, fluid substances enclosed in a deformable bag housed inside a container.

More specifically, it refers to a device wherein the extraction of the bag out of the container, whenever the bag has been emptied of the substance contained therein, takes place simultaneously with removing the pump from the neck of the container and its respective ring cap element connecting the pump and the bag to said neck.

It is a known practice to enclose fluid substances, be they liquid and creamy, inside containers from which such substances are dispensed via the manual operation of a pump mounted on the mouth of a respective container. Operating the pump results in drawing predetermined quantities of the fluid substance from the container, in which, if the container is rigid, a vacuum would be formed which would prevent further drawings and dispensations of the substance, if entry of air were not provided to inside the container (which, in general, takes place at the contact and sliding areas of the pump onto the body of the pump itself), or if the container would not comprise a sealed movable bottom along the inner cylindrical surface of the container itself.

The latter system used to compensate for the volume of the containers in order to decrease the internal volume thereof and keep the internal pressure constant therein, however, is rather laborious and expensive.

An alternative system consists of introducing the fluid to be dispensed into a bag made from a deformable and flexible material, containing in turn a neck which the dispensing pump is connected to. The bag and pump assembly is then introduced into an external container.

Systems using a bag are also usually used for systems of the "air less" type.

Such device is disclosed, for instance, in Japanese patent applications JP 05 031790 and JP 05 031791. In these documents, the bag features a neck from which a flange transversally projects and, in use, the free edge rests on the neck of the external container.

It is also known from US 2004/0112921 to associate the pump with the neck of the bag via a ring cap element which is screwed onto the neck of the external container. In this way, the pump is held pressed by the ring cap to provide a sealing contact with the flange projecting from the neck of the bag, whereas paths are provided in order for air to flow from the outside into the space between the outer surface of the bag and the inner surface of the container to make it possible for the bag to shrink onto itself as the quantity of the fluid substance dispensed by the pump increases.

In these devices, when the dispensation of the fluid substance is over, the ring cap that holds the pump is unscrewed from the neck of the container and removed, whereas the bag remains inside the container. This represents a problem for a correct disposal of the device, because, should the bag be contained in a glass container, these two elements should be disposed separately. Furthermore, a manual extraction of the bag from the external container is difficult to perform.

A solution to this problem is disclosed in patent application EP 2,243,557, wherein the dispensing device is provided with connection means which comprise: a first ring cap screwed onto the neck of the container and on which the flange of the neck of the bag rests, and a second ring cap which carries the pump and is mounted onto the first ring cap, so as to press the flange against the first ring cap. Coupling means are provided between the first and second ring caps, which make the ring caps torsionally integral with each other so that, whenever a rotation is imparted to the second ring cap, also the first ring cap is unscrewed from the neck of the external container. Since the flange of the bag is held pressed between the first and second ring caps, removing the ring caps also results in a simultaneous extraction of the bag from the external container.

This double-ring-cap system, even though allowing an optimum and reliable connection to the container of the bag and of the pump associated therewith, and allowing a simultaneous extraction of these components from the container, entails a substantial radial dimensioning of the ring cap elements. Such dimensioning is not convenient for bottles having necks of the container of a small diameter (for instance, a diameter ranging from 10 mm to 50 mm or from 10 mm to 30 mm).

An object of the present invention is therefore to provide a device to contain and dispense fluid substances wherein the means used to connect the pump and the neck of the bag to the neck of the container have reduced outer dimensions, while guaranteeing the extraction of the bag from the container when said means are removed from the neck of the container.

Another object of the invention is to provide a device to contain and dispense fluid substances that has a simple construction and whose operation is reliable and safe.

These objects and others are achieved by realizing a device to contain and dispense fluid substances realized according to the technical teachings of the attached claims.

Further features and advantages of the invention will be apparent from the description of a preferred but not exclusive embodiment of the device to contain and dispense fluid substances, illustrated for explanatory hence not limitative purposes in the attached drawings, wherein:

FIGS. 1 thru 4 are cross-sectional views of a device according to the invention during successive assembling steps;

Figure 1:
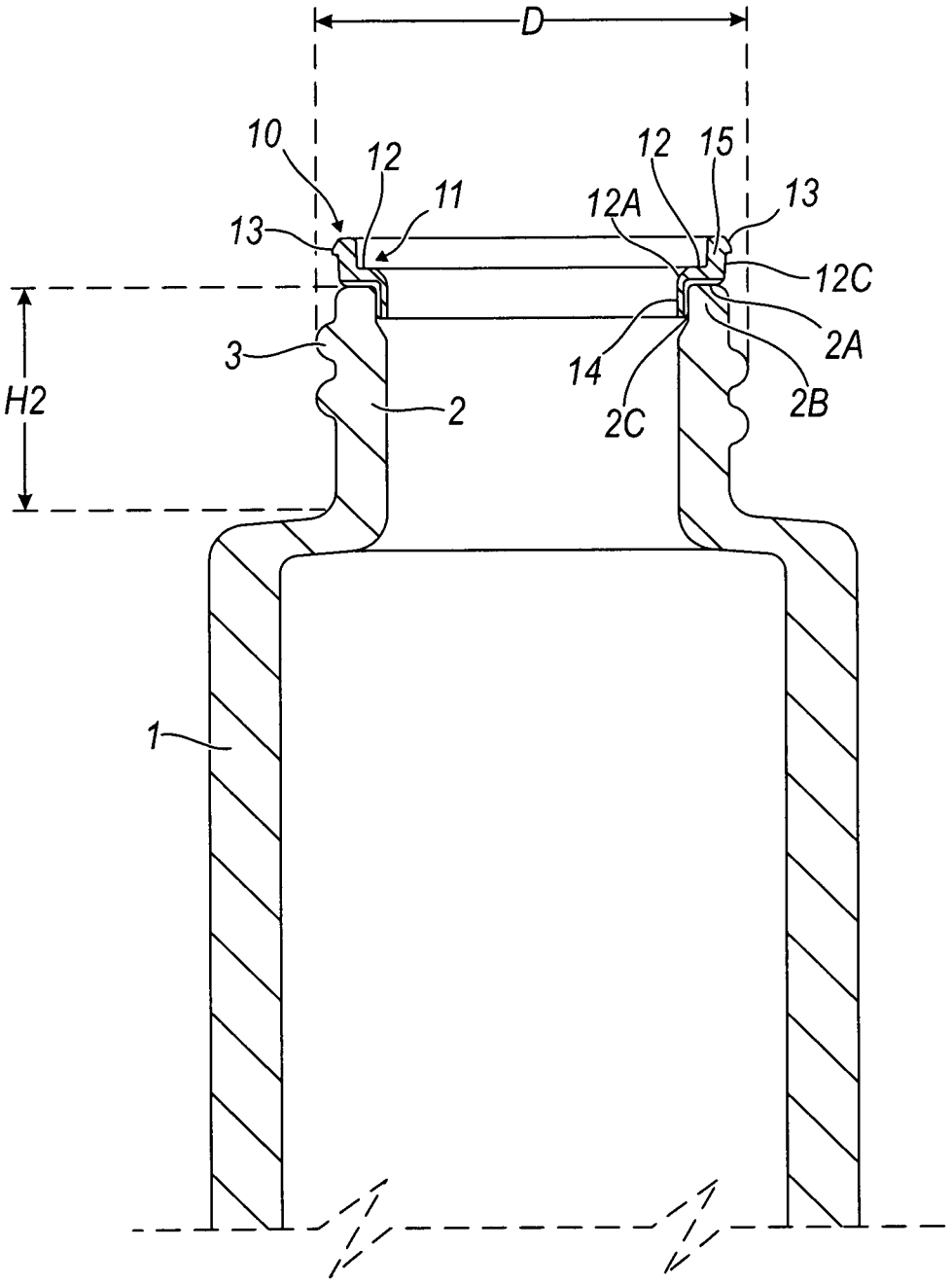
Figure 2:
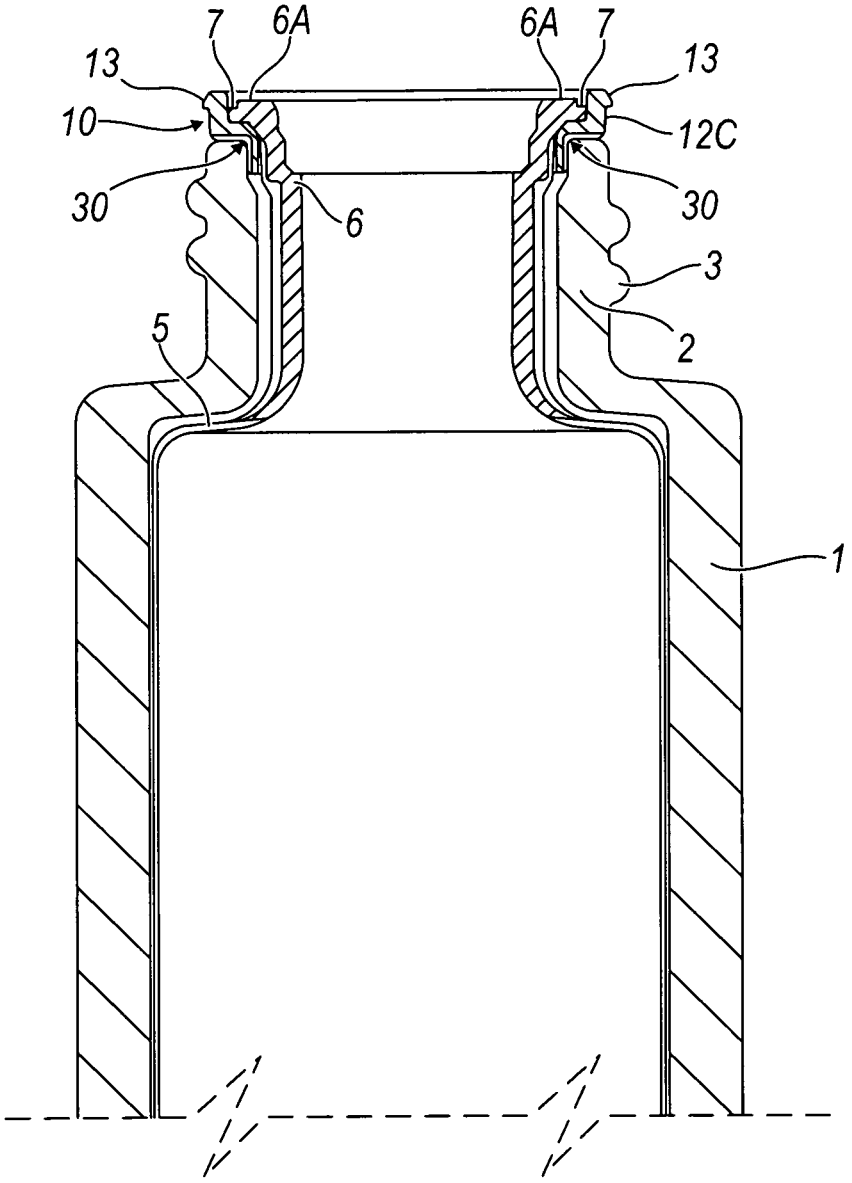
Figure 3:
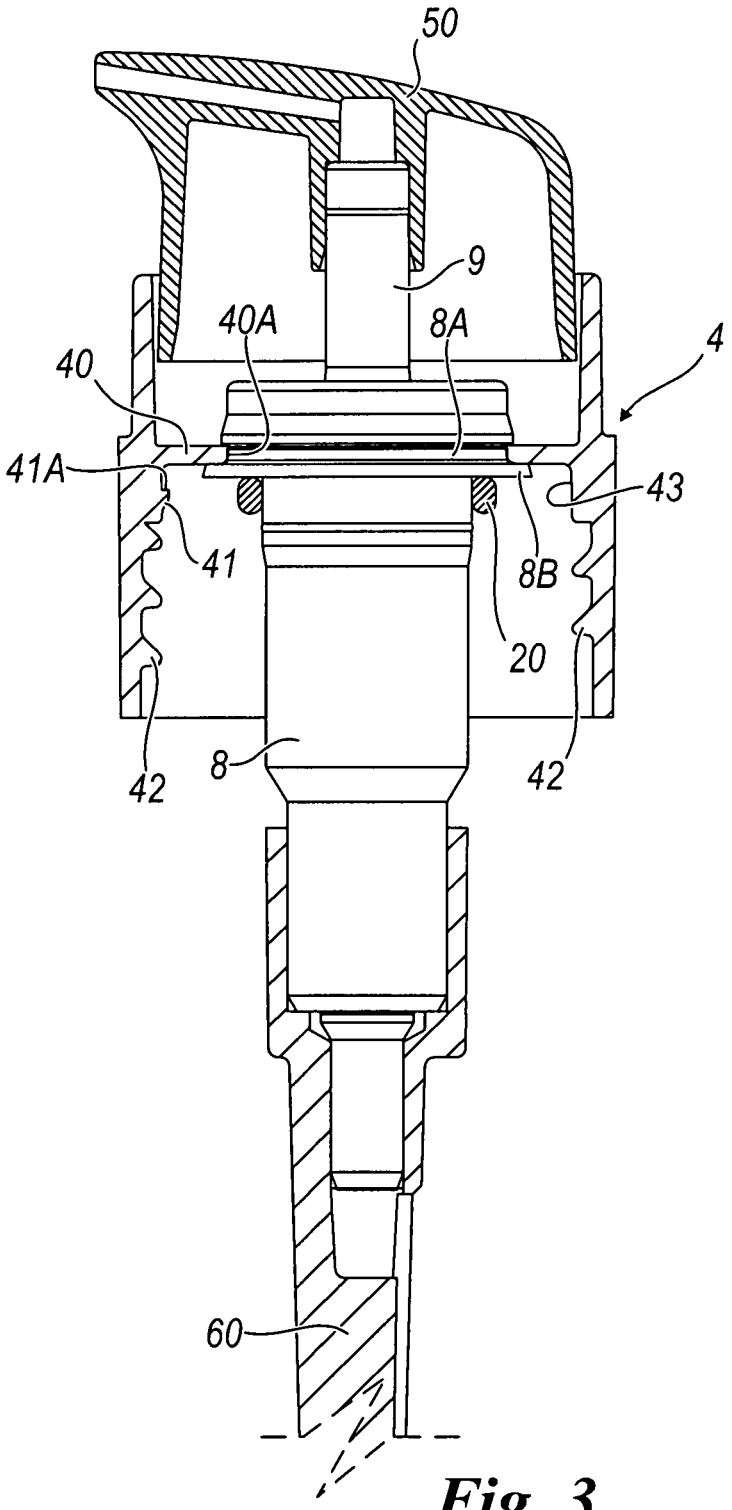

With reference to FIGS. 1 thru 9, a device is shown to contain and dispense fluid substances according to the invention, comprising a container 1 comprising a neck 2 having an opening to access a cavity of the container and having connection means 3 to connect to a ring cap element 4 (FIGS. 1 and 3).

The fluid substance to be dispensed can be of a type whatsoever, but preferably it is a cream.

The device according to the invention also comprises a bag 5 made from a deformable material, housed inside the cavity of the container 1 and comprising a neck 6 having an opening to access the cavity of the bag 5. The bag 5 is provided with a flange 7 which extends transversally from the neck 6 of the bag 5.

More specifically, the bag 5 is preferably made from a thermoplastic material, but it is possible for the bag to be made from any other deformable material suitable for containing a fluid substance, for instance aluminium or a material formed of a plurality of materials sandwiched between each other, in any case of a type conventional to those skilled in this art.

In the context of the present invention, by transversally extending flange we mean a flange 7 that extends in a direction not parallel to a longitudinal axis of the neck 6 of the bag 5, so as to present a surface suitable for resting on a corresponding rest surface of an annular element 10 described below in detail.

In the figures, the flange 7 is shown perpendicular to the neck 6 of the bag 5, but it is possible for the flange 7 to be inclined with respect to the same neck 6, for instance by an angle ranging from 20 to 70 degrees and preferably equal to approximately 45°.

The device to contain and dispense a fluid substance also comprises a pump 8 which can be manually operated to draw the fluid substance from the bag 5 and to feed it to the outside via a dispensing stem 9 of the pump 8 itself, the pump 8 being at least partially housed in the neck 6 of the bag 5 (as shown in FIGS. 4 thru 7). The pump can be of a known type whatsoever.

Preferably, the pump is of the "air less" type and is sealingly connected to the neck of the bag. A pump of this type is for instance suitable for creating in the bag 5 a maximum vacuum (with respect to the atmosphere pressure) ranging from approximately 400 to 800 millibars, and more preferably equal to approximately 600 millibars. The bag 5 is completely deformed or collapsed in this range of maximum pressures. Therefore, in the present context, by deformable bag we mean a bag whose walls are completely collapsed at the pressures created by the pump as specified here above.

It is also worth noting that the flange 7 can also be deformable, or rigid. In the context of the present invention, by rigid flange we mean a flange that does not get deformed at the above mentioned pressures.

The device to contain and dispense a fluid substance comprises a ring cap element 4 connected to the neck 2 of the container 1, and suitable for connecting the pump 8 and the bag 5 to the neck 2 of the container 1.

Figure 5:
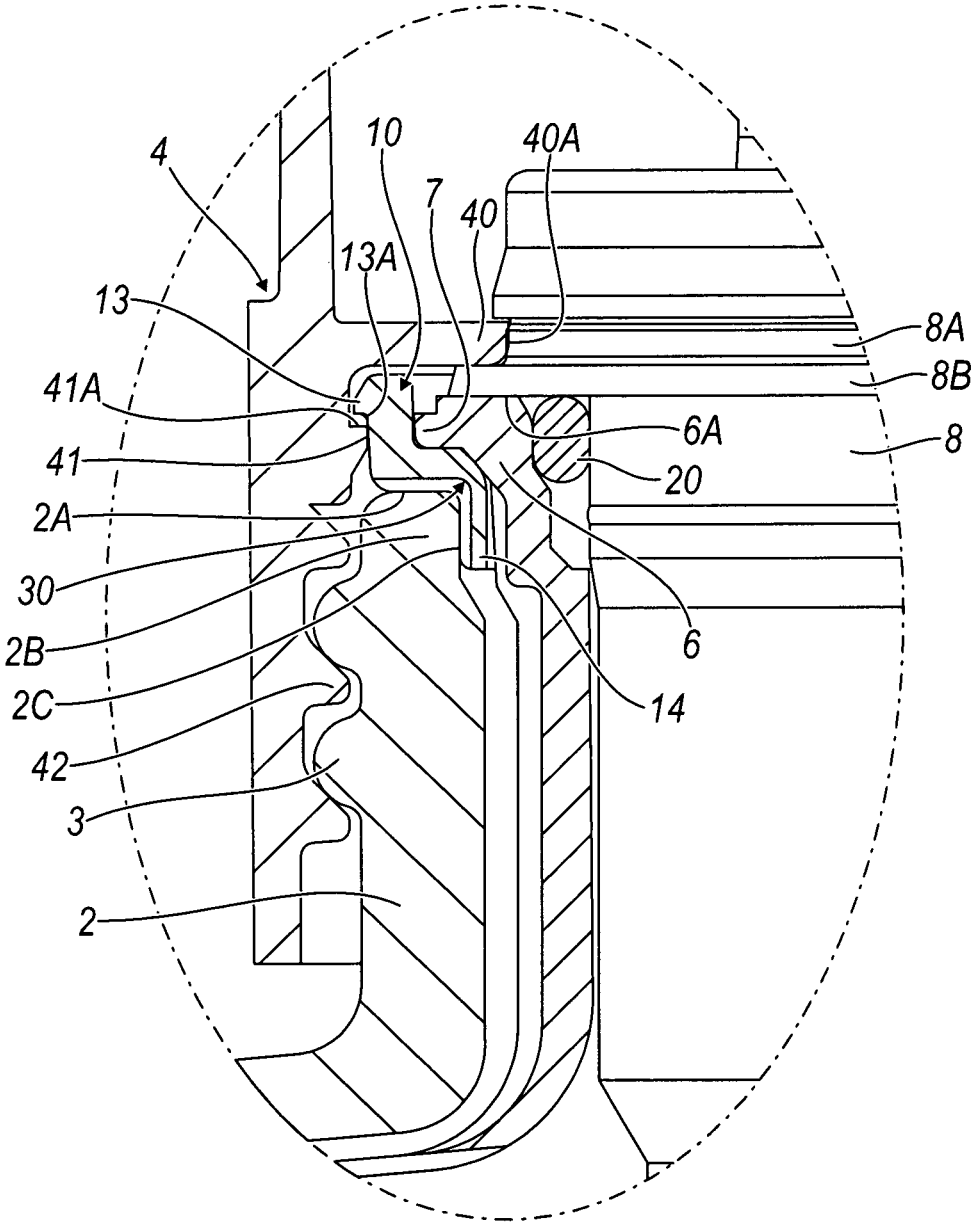
FIG. 5 is an enlarged view of a detail of FIG. 4.

Let's point out that the pump 8 is bound to the ring cap element 4 via an upper annular wall 40 of the latter, whose inner edge 40A is to be inserted into an appropriate circular groove 8A cut in the body of the pump 8 (see in particular FIGS. 3 and 5). The pump 8 also includes a circular flange 8B which projects transversally to the body of the pump 8, immediately below the groove 8A, so that said connection of the pump 8 and of the bag 5 to the neck 2 of the container 1 takes place thanks to a downward pressure exerted by the upper annular wall 40 of the ring cap element 4 onto the circular flange 8B of the pump 8.

The device according to the invention is also provided with an annular support element 10 suitable for being arranged and resting on the free edge 2A of the neck 2 of the container 1. The annular support element 10 comprises a seat 11, suitable for housing in a rest position, on at least one rest wall 12, at least one portion of the flange 7 of the neck 6 of the bag.

The ring cap element 4, whenever connected to the neck 2 of the container 1, binds the annular support element 10 and the flange 7 to each other, and the annular support element 10 to the neck 2 of the container 1.

One ring cap element 4 is preferably provided suitable for connecting to the neck 2 of the container 1: the pump 8, the bag 5, and the annular support element 10.

The annular support element 10 also comprises connection means 13 suitable for cooperating with connection counter-means 41 which the ring cap element 4 is provided with, to steadily bind the annular support element itself and the ring cap element 4 to each other.

In the context of the invention, by steady bond we mean such a bond that, the annular support element 10 and the ring cap element 4, once bound to each other, do not disconnect from each other when the ring cap element is dissociated and moved away from the neck of the container, so that moving said ring cap element away results in also automatically pulling away the bag from the container. The bag can be dissociated from the ring cap element indeed, but such operation requires the application to the bag of an appropriate force of a substantial intensity, much higher than the friction one exerted by the walls of the container which the deformed bag is to be extracted from whenever all the substance originally contained therein has been substantially dispensed.

Note that the upper circular wall 40 of the ring cap element 4, the circular flange 8B of the pump 8, the flange 7 of the neck 6 of the bag 5, and the rest wall 12 of the annular support element 10, which are superimposed to each other in use, define coupling means which couple the pump 8, the bag 5, the annular support element 10, and the ring cap element 4 with each other.

As a matter of fact, as already said, the upper annular wall 40 of the ring cap element exerts a downward pressure onto the flange 8B of the pump 8. In its turn, the circular flange 8B of the pump 8 exerts a pressure onto the upper edge 6A of the neck 6 of the bag 5 (see in particular FIG. 5). This pressure determines a pressure exerted by the flange 7 onto the rest wall 12 of the annular support element 10.

Figure 4:
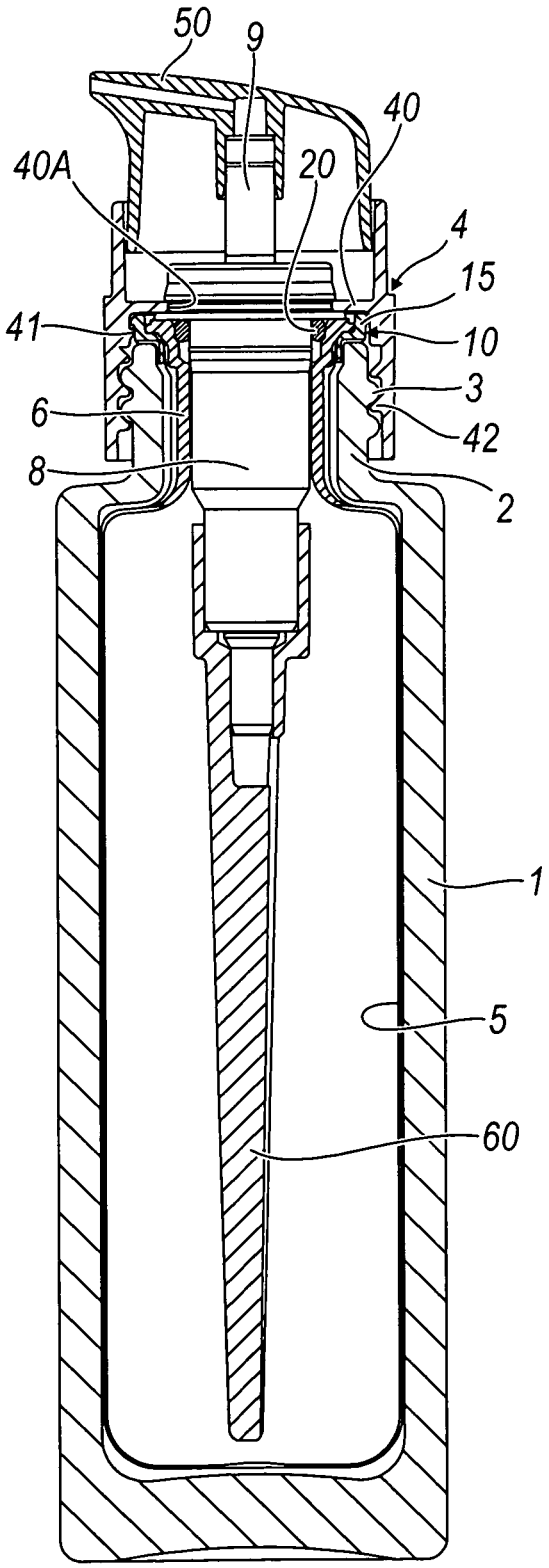

Note that, as clearly shown in FIGS. 4 and 5, the upper annular wall 40 of the ring cap element 4, the flange 8B of the pump 8, the upper surface 6A of the neck 6 of the bag 5, the flange 7, and the rest wall 12 of the annular support element 10 are parallel to each other.

According to the present invention, the ring cap element 4 comprises connection counter-means 42 suitable for cooperating directly with the connection means 3 of the neck 2 of the container 1 to removably connect the ring cap element 4 and the neck 2 of the container 1 to each other.

In this way, the ring cap element 4 is directly connected to the neck 2 of the container 1 and consequently can have a radial dimension just higher (for instance 2%-10% higher) than that of the same neck 2 of the container 1.

In the examples shown in the figures, the connection means 3 of the neck 2 and the connection counter-means 42 of the ring cap element 4 comprise a thread and an internal-thread respectively, such that the ring cap element 4 is to be screwed in around the neck 2 of the container 1. However, it is possible to use other connection means and connection counter-means of a conventional type to those skilled in the art, suitable for operating a removable connection of the ring cap element 4 onto the neck 2 of the container 1.

The support of the flange 7 of the bag 5 is obtained through the rest wall 12 of the annular support element 10, which rests on the neck 2 of the container 1.

As shown in figures, the annular support element 10 rests on the free edge of the neck 2 of the container 1 whenever the ring cap element 4 is connected to the outer lateral surface of said neck 2 of the container 1.

For this purpose, it is preferred that the rest wall 12 of the annular support element 10 have a width L1 substantially equal to the thickness L2 (FIG. 7) of the free edge of the neck 2 of the container 1. It is possible to have the width L1 of the rest wall 12 smaller than the thickness L2 of the neck 2 of the container 1, or greater than the thickness L2 of the neck 2 of the container 1.

Advantageously the rest wall 12 has an annular shape and has an inner edge 12A and an outer edge 12B. In the example shown in the figures, the inner edge 12A has a chamfering which substantially corresponds to an outer chamfering provided in the bag 5, between the outer wall of the neck 6 of the bag 5 and the lower face of the flange 7 of the same bag 5. The presence of such chamferings makes it possible to get a better seal between the annular support element 10 and the neck 6 of the bag 5.

Preferably, the annular support element 10 comprises a centering and positioning portion 14, projecting downwards from the rest wall 12, and suitable for engaging an inner or outer, upper portion 2B of the neck 2 of the container 1. This centering and positioning portion 14 makes it possible to appropriately center and position the annular support element 10 onto the neck 2 of the container 1, and consequently simplifies the operations necessary to correctly associate the annular support element 10 with the neck of the container.

Preferably, the centering and positioning portion 14 has a limited height H1 (FIG. 9) less than or equal to 20% of the height H2 (FIG. 1) of the neck 2 of the container 1, preferably less than or equal to 10% of said height H2, and even more preferably less than or equal to 5% of said height H2. Such dimensioning of the centering and positioning portion 14 makes it possible to warranty a steady positioning of the annular support element 10 onto the upper edge 2A of the neck 2 of the container 1, suitable for preventing accidental displacements of said annular support element 10. In other words, such height of the centering and positioning portion 14 makes it possible for the annular support element 10 to remain in position on the neck 2 whenever the bag 5 is not there, and even if the container 1 is handled.

Note that the centering and positioning portion 14 might have a height greater than that indicated above, but such solution is less preferred because it would be more difficult to insert it into the neck 2 of the container 1, and it would not allow to significantly improve the stability of the annular support element 10, because of the surface of the inner wall of the neck 2 which is generally irregular. Furthermore, limiting the dimension of the centering and positioning portion 14 down to the values specified above results in also limiting the consumption of the material which it is made from.

In the example illustrated in the figures, the centering and positioning portion 14 comprises a tubular wall featuring such a stiffness as to make it possible to hold the support element 10 in position on the neck 2 of the container 1. In the example here illustrated the tubular wall is continuous, but it might also include different portions separate from each other.

The centering and positioning portion 14 preferably has a thickness less than or equal to 20% of the thickness of the neck 2 of the container 1. In this way, the thickness of the centering and positioning portion 14 is sufficient to warranty the stability of the annular support element 10 on the neck 2 of the container 1, and at the same time is sufficiently limited not to prevent the correct insertion of the bag 5 into the neck 2 of the container 1.

As can be seen in the figures, it is possible to make the upper portion 2B of the neck 2 of the container 1 have a hollow 2C to house the centering and positioning portion 14 of the annular support element 10. Conveniently, such hollow 2C has a depth substantially equal to or greater than the thickness of the centering and positioning portion 14, so that the coupling surfaces facing the inside of the container of said neck 2 and of said centering portion 14 form a substantially continuous surface without substantial steps, suitable for fostering the insertion of the bag. However, it is to be pointed out that the hollow 2C is optional, and the centering and positioning portion 14 of the annular support element 10 can be inserted along the inner wall of the neck 2 of the container 1 without preventing the correct positioning of the neck 6 of the bag 5 inside the neck 2 of the container 1.

In the variant illustrated in FIGS. 1 thru 9, the centering and positioning portion 14 is suitable for engaging an inner upper portion 2B of the neck 2. In this first variant of the invention, the centering and positioning portion 14 projects from the inner edge 12A of the rest wall 12. However, the rest wall 12 might also have an inner edge 12A whose diameter does not equal the inner diameter of the neck 2 of the container 1, but is smaller. In this case, the centering and positioning portion 14 might project from an intermediate zone of the rest wall 12, in correspondence with the inner diameter of the neck 2 of the container 1.

According to a particularly advantageous aspect of the present invention, the maximum diameter of the annular support element 10 is less than or equal to the maximum diameter of the neck 2 of the container 1. This feature makes it possible to house the annular support element 10 in use inside the ring cap element 4 without being obliged to increase its radial dimensions, to the advantage of compactness for the ring cap element 4.

By maximum diameter of the neck 2 of the container 1 we mean the maximum diameter D1 (FIG. 1) of the neck 2 including the connection means 3. Likewise, by maximum diameter D2 (FIG. 9) of the annular support element 10 we mean the maximum diameter thereof, account also being taken of the connection means 13 connecting to the ring cap 4.

According to a preferred aspect of the invention, the connection means 13 of the annular support element 10 comprise at least one circular tooth projecting from a free outer surface of the annular support element 10.

By outer surface of the annular support element 10, we mean a surface that is not in contact with the neck 2 of the container 1, and oriented externally with respect to the neck 2 of the container 1. By free surface, conversely, we mean a surface that is not engaged by the flange 7 of the bag 5.

For instance, should the flange 7 of the bag 5 comprise a plurality of sectors reciprocally spaced from each other, the connection means 13 of the annular support element 10 might project from a portion of the upper surface of the rest wall 12 interposed between two of said sectors of the flange 7.

Likewise, the connection means 13 might also project from the outer surface 12C of the rest wall 12.

Figure 8:
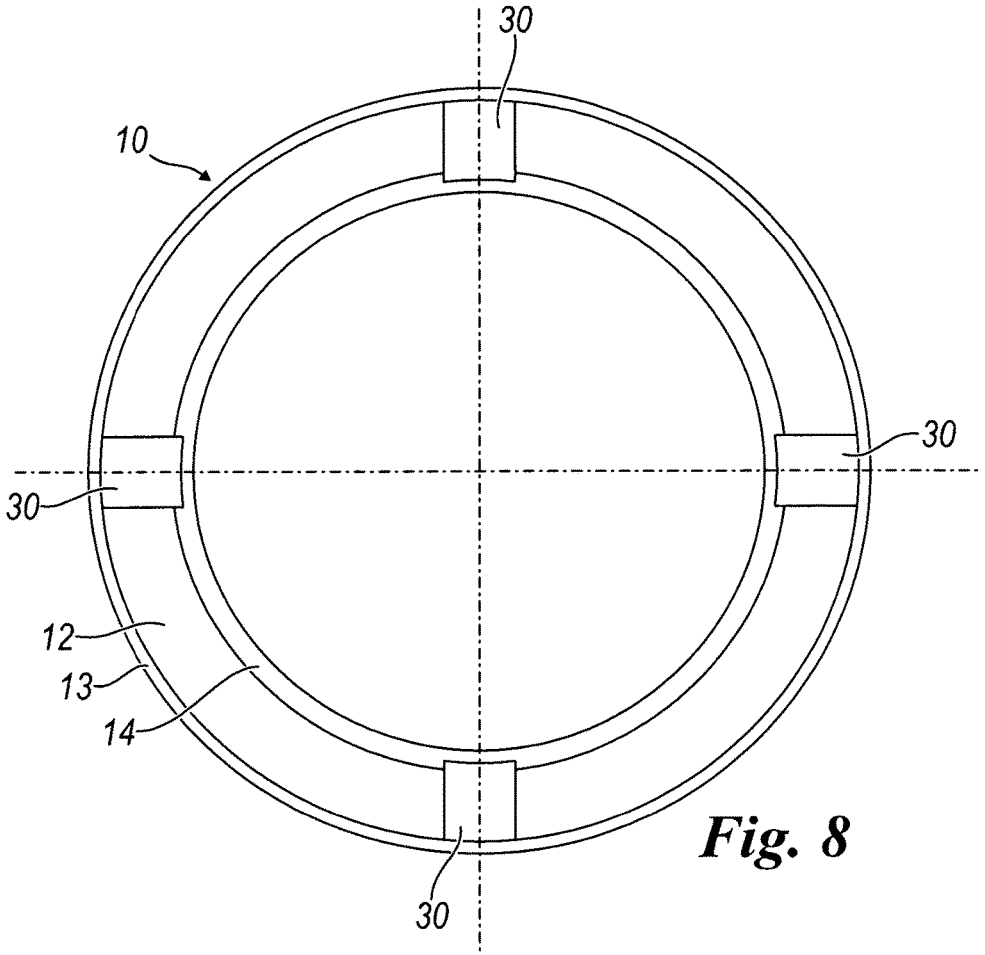
FIGS. 8 and 9 are a bottom view and a cross-sectional view respectively of an annular support element of the invention.
Figure 9:
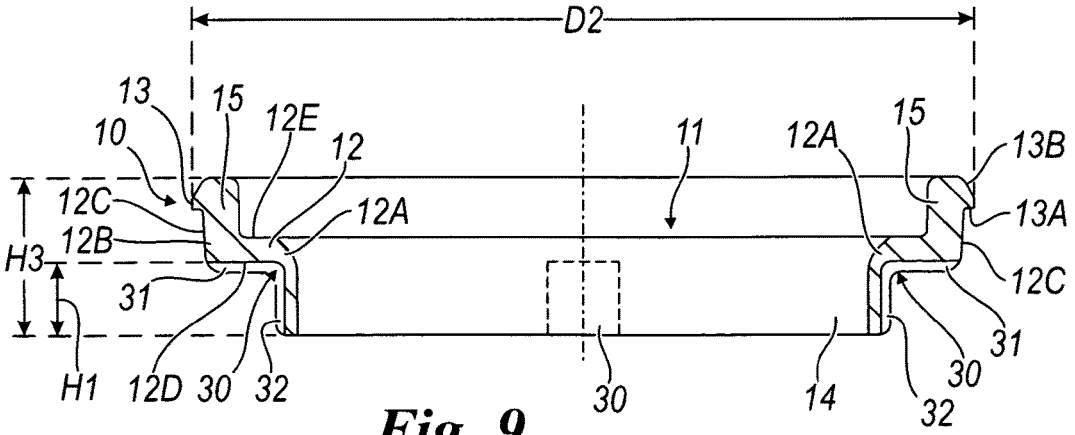
Figure 10:
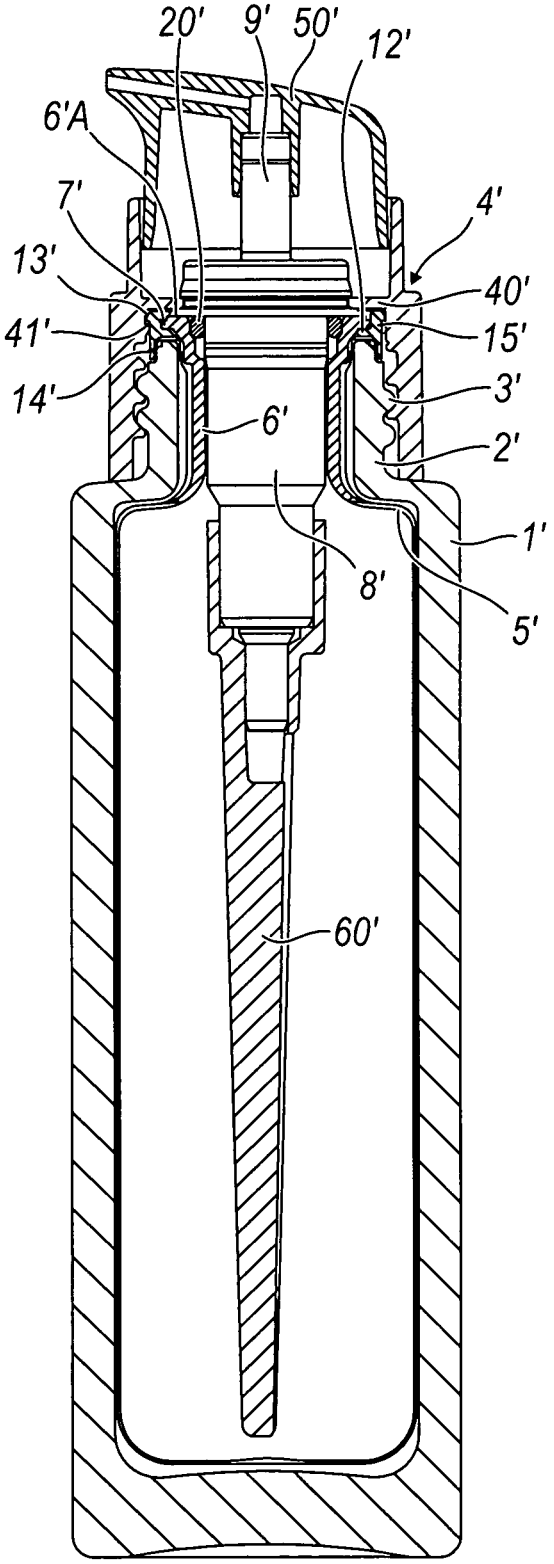
FIG. 10 is a cross-sectional view of a variant of the device according to the invention.
Figure 11:
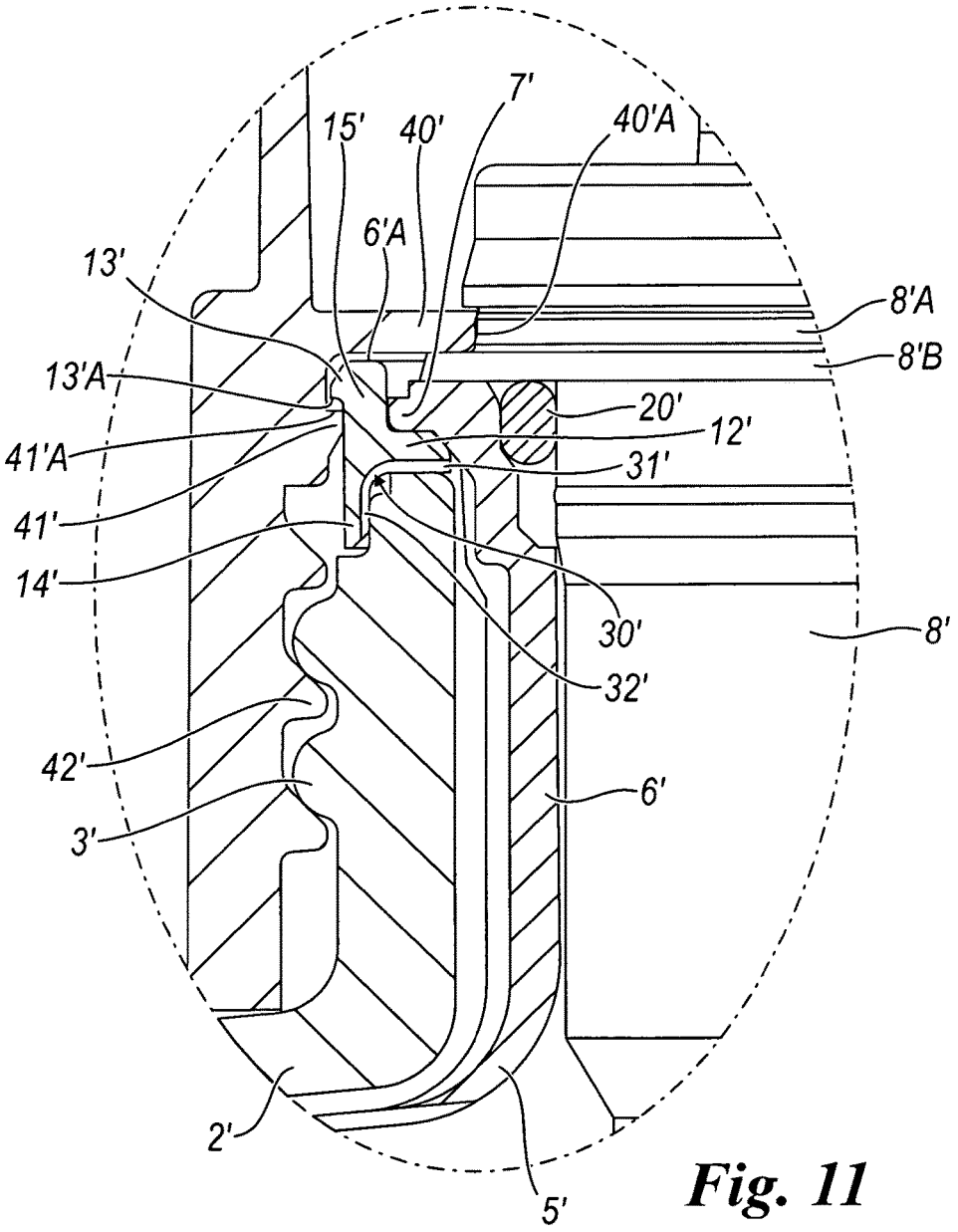
FIG. 11 is an enlarged view of a detail of FIG. 10.
Figure 12:
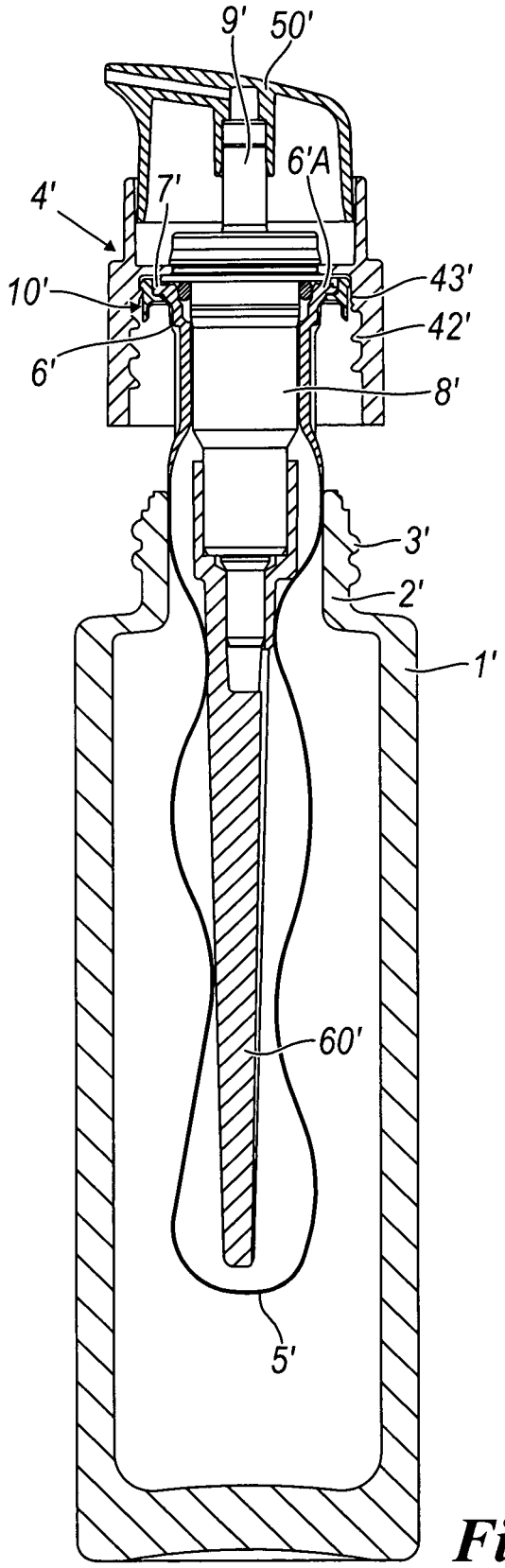
FIG. 12 is a cross-sectional view of a second variant of the device according to the invention during the same step of use as in FIG. 6.
Figure 13:
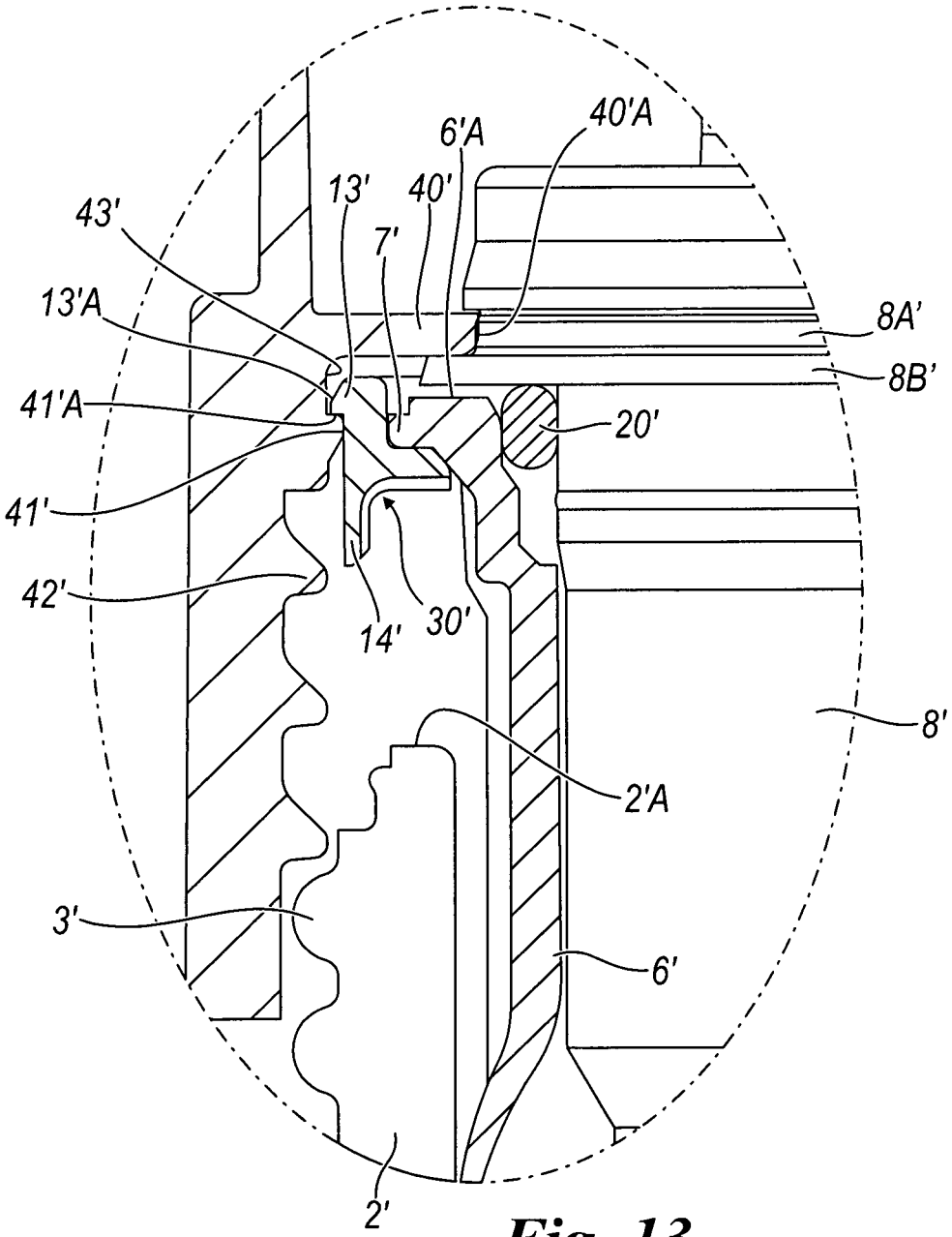
FIG. 13 is an enlarged view of the detail of FIG. 12.
Figure 14:
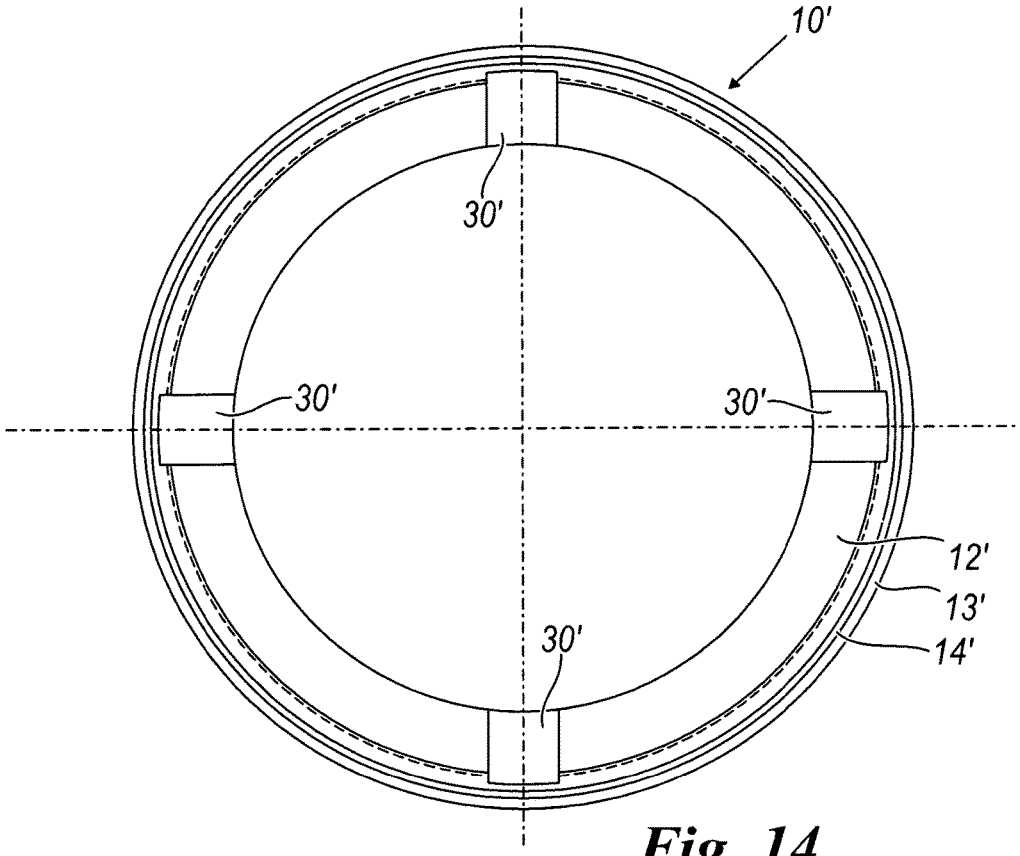
FIGS. 14 and 15 are a bottom view and a cross-sectional view respectively of a second variant of the annular support element of the invention.
Figure 15:
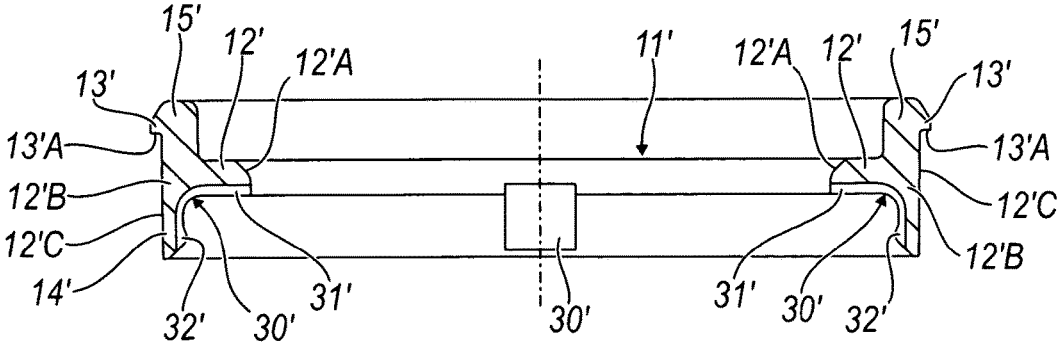

According to a preferred embodiment of the invention, as illustrated in the drawings, the annular support element 10 comprises at least one upper element 15 which departs substantially perpendicularly from the outer edge 12B of the rest wall 12, and from which the connection means 13 project (FIGS. 5, 8, and 9).

More specifically, the connection means 13 project from an upper portion of the upper element 15.

In the example here illustrated, the connection means 13 comprise a circular tooth which extends toward the outside of the upper element 15 of the annular support element 10. The connection means 40 of the ring cap element 4 are provided on an inner surface 43 of the latter, advantageously above the connection counter-means 42 suitable for engaging the connection means 3 of the neck 2 of the container 1.

However, the connection means 13 might comprise a circular tooth which projects toward the inside of the upper element 15 of the annular support element 10, provided it projects from a surface thereof that is not engaged by the outer edge of the flange 7 of the bag 5. This solution is less preferred because it would require to provide connection counter-means (not shown) that project downwards from the upper surface 40 of the ring cap element 4. Therefore, this solution is less simple to implement.

Also, the tooth of the connection means 13 might project from the upper surface of the upper element 15 itself of the annular support element 10.

It is to be pointed out that, in order to get a suitable connection between the ring cap element 4 and the annular support element 10 it is advisable that the upper element 15 have a thickness greater than the thickness of the centering and positioning portion 14.

In the example here illustrated, the connection means 13 of the annular support element 10 comprise one continuous circular tooth only. It goes without saying that it is possible that the connection means 13 comprise a plurality of teeth spaced from each other and arranged along one and the same circumference.

Should the connection means 13 comprise one continuous circular tooth only, the connection counter-means 41 of the ring cap element 4, which the circular tooth is suitable for engaging, advantageously comprise a plurality of teeth arranged along a circumference. In this way, the connection of the continuous circular tooth of the annular support element 10 to the teeth of the ring cap element 4 can easily take place by snap and simultaneously provides a tight coupling suitable for preventing the annular support element 10 from detaching from the ring cap element 4 upon removal of the latter from the neck 2 of the container 1, so as to simultaneously extract the bag 5 from the cavity of the container 1 when all substance originally contained in the bag has been substantially extracted from the bag itself.

Alternatively, the connection means 13 of the annular support element 10 might comprise a plurality of connection teeth. In this case, it is particularly advantageous for the connection counter-means 41 of the ring cap element 4 to comprise one continuous circular tooth only.

Figure 6:
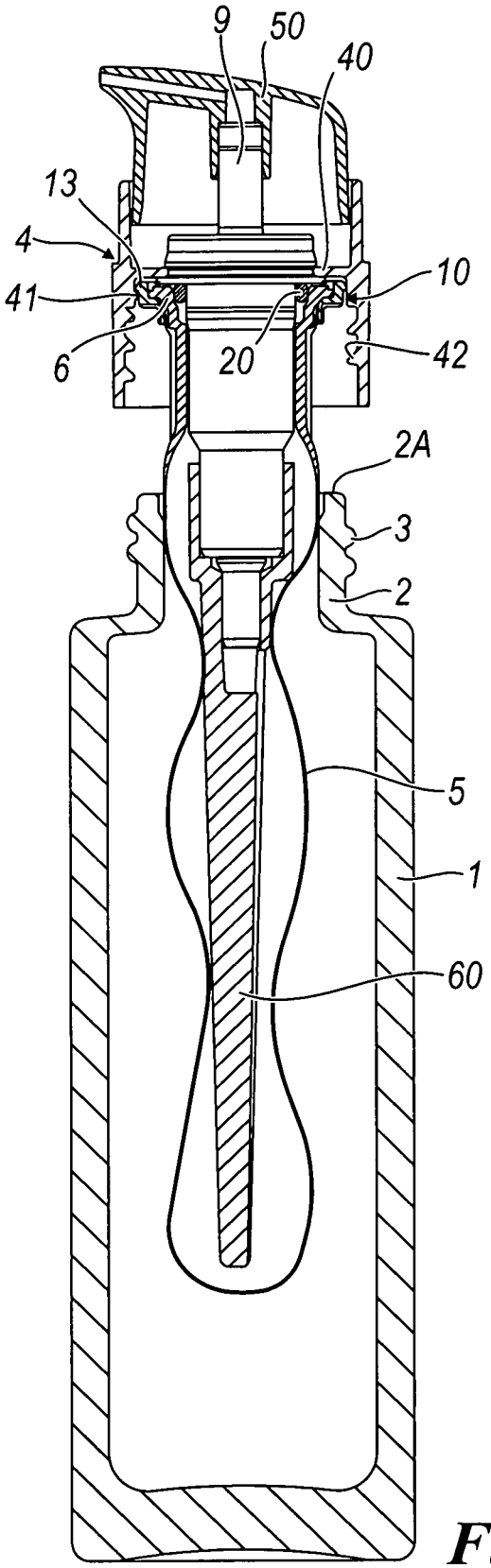
FIG. 6 is a cross-sectional view of the device according to the invention during a further step of use.
Figure 7:
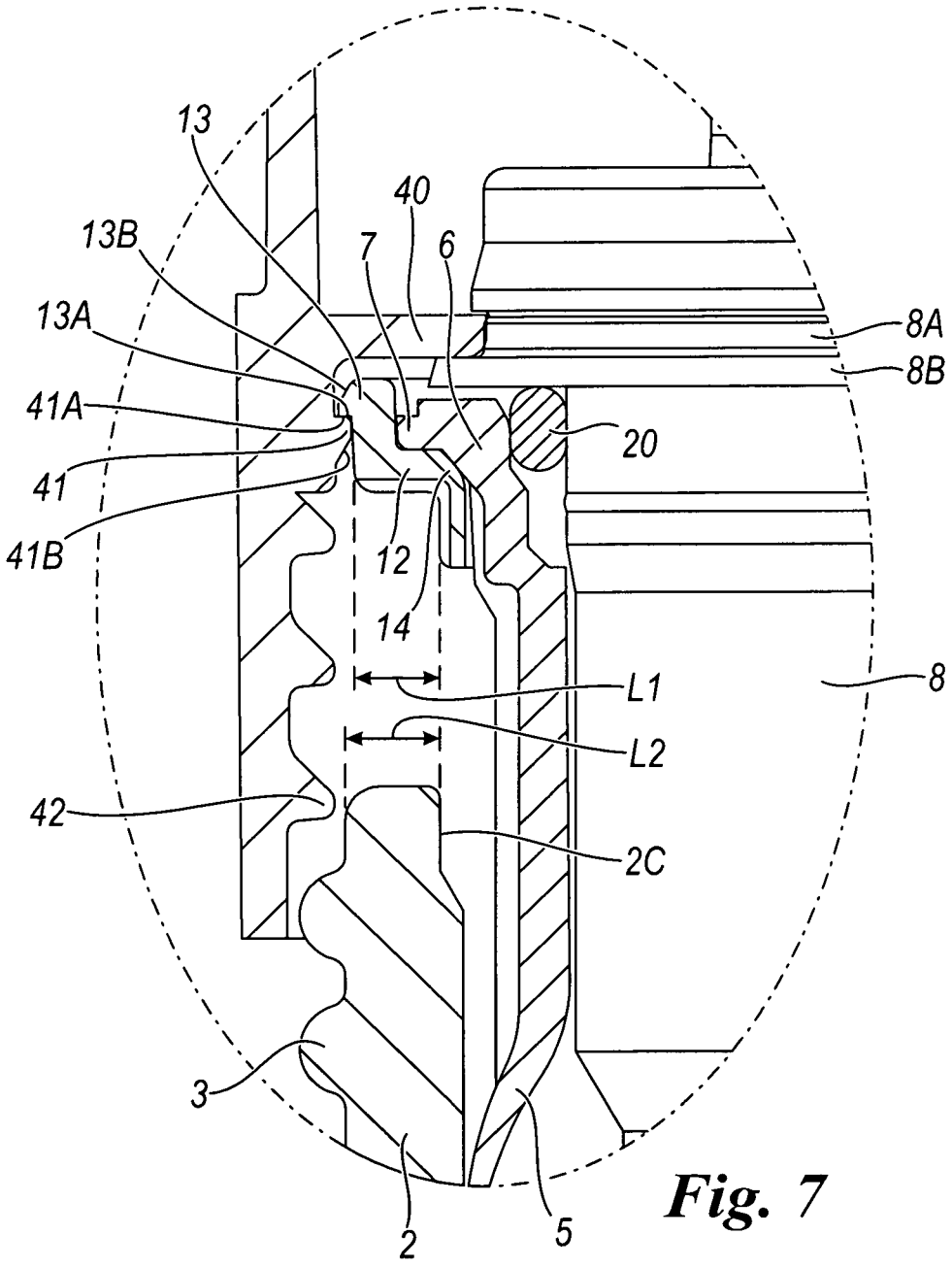
FIG. 7 is an enlarged view of a detail of FIG. 6.

It is to be pointed out that the connection means 13 of the annular support element 10 comprise a connection surface 13A suitable for cooperating with a counter-surface of connection 41A of the connection counter-means 41 of the ring cap element 4, at least during the ring cap element removal step. As a matter of fact, such cooperation enables the above mentioned steady bond between the ring cap element 4 and the annular support element 10, which makes it possible to extract the bag 5 from the container 1 simultaneously with the removal of the ring cap element 4 (FIGS. 6 and 7).

It is to be emphasized that advantageously the connection means 13 of the annular support element 10 comprise an inclined surface 13B (FIG. 9) suitable for cooperating with an inclined counter-surface 41B (FIG. 7) of the connection counter-means 41 of the ring cap element 4, and that such inclined surfaces are so shaped as to foster a snap coupling of the surfaces 13A 41A whenever the ring cap element is associated with the neck of the container.

According to an advantageous aspect of the invention, the annular support element 10 comprises at least one substantially flat wall 12, having a lower surface 12D suitable for resting on the upper free edge 2A of the neck 2 of the container 1 and an upper surface 12E on which at least a portion of the transversal flange 7 of the bag 5 rests. In addition, the width L1 of the lower rest surface 12D is substantially equal to the width L2 of the upper free edge 2A of the neck 2 of the container 1 (FIG. 7).

According to another advantageous aspect of the invention, from the at least one flat wall 12 a substantially vertical wall 15 departs perpendicularly outwards, and the connection means 13 suitable for cooperating with the connection counter-means 41 provided in the ring cap element 4, to steadily bind the annular support element 10 and the ring cap element 4 to each other, depart and project from a face oriented toward the outside of the at least one vertical wall 15.

Note that when the ring cap element 4 connects the pump 8 and the bag 5 to the neck 2 of the container 1, as one can see in FIGS. 4 and 5, it is not necessary that the connection surface 13A of the connection means 13 be in contact with the connection counter-surface 41A of the connection counter-means 41 (see in particular FIG. 5).

It is also to be noted that, preferably, the overall height H3 of the annular support element 10 is less than at least 50% of the overall height H2 of the neck 2 of the container 1, more preferably is less than 30% of the height of the neck 2 of the container 1, and even more preferably is less than 20% of the overall height of the neck 2 of the container 1.

In the device to contain and dispense a fluid substance according to the invention, the pump 8 suitable for drawing and dispensing the fluid substance can be of a type whatsoever. However, it is particularly advantageous to provide a pump of the "airless" type airtightly connected to the neck 6 of the bag 5, as shown in the figures. In the case of an airless pump, it is preferred to provide a gasket member 20 between the body of the pump and the neck 6 of the bag 5.

The presence of a gasket member 20 is particularly worth in the case that the pump is of the airless type and the flange 7 of the bag 5 is substantially rigid. As a matter of fact, if the flange 7 is made from a deformable material, pressing it against the rest wall 12 of the annular support element 10 would make it possible to realize a sufficient air tightness for a good operation of the airless pump.

In the preferred case whereby the pump is of the airless type, it is particularly advantageous that the device according to the invention comprise at least one passage channel 30 for the air flow between the outside of the container 1 and a gap existing between the inner surface of the cavity of the container 1 and the outer surface of the bag 5 housed in said cavity. Such passage channel 30 allows the bag 5 to collapse as the fluid substance is dispensed.

Being the annular support element 10 suitable for resting on the free edge 2A of the neck 2 of the container 1, it presents at least one surface suitable for getting in contact with the neck 2 of the container. Advantageously, such at least one contact surface includes said passage channel 30 for the air flow.

In the variant illustrated in FIGS. 1 thru 9, the annular support element 10 includes four passage channels 30 for the air flow in the gap between the container 1 and the bag 5. These passage channels are determined by grooves cut in the lower surface of the rest wall 12 and in the outer surface of the centering and positioning portion 14.

Still with reference to the variant shown in FIGS. 1 thru 9, wherein the centering and positioning portion 14 engages the inner wall of the neck 2 of the container 1, every groove has a first substantially horizontal sector 31, cut in the lower surface of the rest wall 12, and a second section 32 cut in the outer surface of the centering and positioning portion 14 (FIGS. 8 and 9).

Note that the passage channels 30 for the air flow might be obtained by providing a plurality of members projecting from the at least one contact surface of the annular support element 10 with its corresponding surface of the neck of the bottle.

For the sake of completeness, it is to be pointed out that it is preferred to provide a dispenser plug 50 which is to be mounted on the dispensing stem 9 of the pump 8, as well as a sucking element 60 which is connected to the lower part of the pump 8 and is dipped into the fluid substance to be drawn. Such elements, which are well known by those skilled in the art, are not essential for the implementation of the device to contain and dispense fluid substances according to the present invention.

The operation of the invention is the following.

First of all, the annular support element 10 is positioned on the free edge 2A of the neck 2 of the container 1 (FIG. 1). In this way, the annular support element 10 is resting on the same free edge 2A, centered with respect to the neck 2 of the container 1 and held in position thanks to the centering and positioning portion 14 which engages the inner upper portion 2B of the neck 2 of the container 1.

Then the (preferably deformed) bag 5 is inserted into the container 1, in a manner already known by those skilled in the art. Once this step is over, the flange 7 of the neck 6 of the bag 5 is in turn rested on the rest wall 12 of the annular support element 10 (FIG. 2). Then the bag is filled with the substance to be dispensed Then the ring cap element 4, which the pump 8 is preferably already connected to (FIG. 3), is connected to the neck 2 of the container 1. Connecting the ring cap element 4 to the neck 2 of the container 1 makes the upper annular wall 40 of the ring cap element 4 exert a pressure onto the circular flange 8B of the pump 8, which in turn exerts a pressure onto the upper edge 6A of the neck 6 of the bag 5. Consequently the flange 7 of the bag 5 is pressed against the rest wall 12 of the annular support element 10.

Also, the connection of the ring cap element 4 to the neck 2 of the container 1 results in a reciprocal connection of the connection means 13 of the annular support element 10 to the connection counter-means 41 of the ring cap element 4. In particular, in the example illustrated in FIGS. 1 thru 9, the connection means 13, comprising a continuous circular tooth projecting outwards from the upper element 15, snap connect to the connection counter-means 41, which include a plurality of teeth arranged along a circumference.

The device to contain and dispense fluid substances is now ready for being used by a final user (FIG. 4), who can draw and dispense the substance by pressing the dispenser plug 50, thereby manually operating the pump 8.

Once the fluid substance contained in the bag 5 is exhausted, the ring cap element 4 is removed from the neck 2 of the container 1, through an unscrewing operation in the case here illustrated (FIG. 6). Unscrewing and removing the ring cap element 4 from the neck 2 of the container 1 causes a displacement thereof with respect to the annular support element 10. Because of said displacement, the connection surface 13A of the connection means 13 of the annular support element 10 gets in contact with the connection counter-surface 41A of the connection counter-means 41 of the ring cap element 4 (FIGS. 6 and 7). Such getting in contact makes it possible to hold the annular support element 10 connected to the ring cap element 4, which allows to extract the bag 5 from the container 1 thanks to the flange 7 of the bag 5 which is resting on the rest surface 12 of the annular support element 10.

FIG. 10 thru 15 illustrate a variant of the device to contain and dispense a fluid substance according to the present invention. In these figures, the elements common to the first embodiment as previously described retain the same reference numerals, with a prime added thereto.

According to this second variant, illustrated in FIGS. 10 thru 15, the centering and positioning portion 14' of the annular support element 10' is provided on the outer edge 12'B of the rest wall 12'. Consequently, such centering and positioning portion 14' engages the outer upper portion 2'B of the neck 2' of the container 1'.

In this variant, it is particularly advantageous that the centering and positioning portion 14' have limited dimensions less than or equal to 20% of the length of the neck 2' of the container 1', preferably less than or equal to 10% of the length of the neck 2' of the container 1', and even more preferably less than or equal to 5% of the length of the neck 2' of the container 1', so as to provide a portion of the outer surface of the neck 2' sufficient to realize the connection means 3' connecting to the ring cap element 4' therein.

It is to be noted that, in the example illustrated in FIGS. 10 thru 15, the passage channels 30' for the air flow into the gap between the container 1' and the bag 5' comprise a first substantially horizontal section 31' cut in the lower surface of the rest wall 12', and a second section 32' cut in the inner surface of the centering and positioning portion 14' of the annular support element 10'. In this case, the lower surface of the rest wall 12'.

The invention claimed is:

1. A device to contain and dispense fluid substances, comprising:

a container comprising a neck, having an opening to access a cavity of the container, and having first connection means for connection with a ring cap element;

a bag made from a deformable material, suitable to be housed inside said cavity of the container and comprising a neck having an opening to access a cavity of the bag, said bag being provided with a flange extending transverse to said neck of the bag;

a pump which can be operated manually to draw a fluid substance from the bag and feed the fluid substance outside through a dispensing stem of the pump, said pump being housed at least partially in said neck of the bag;

said ring cap element connected to said neck of the container being suitable to connect said pump and said bag to the neck of the container;

an annular support element suitable to be arranged resting on a free edge of the neck of the container, said annular support element comprising:

a seat comprising at least one rest wall for at least one portion of said flange of the neck of the bag, said ring cap element, when connected to the neck of the container, binding together said annular support element and said at least one portion of said flange, as well as said annular support element to the neck of the container; and second connection means suitable to cooperate with first connection counter-means provided in said ring cap element, to steadily bind together said annular support element and said ring cap element even when said ring cap element is disengaged from the neck of the container, so that, when the fluid substance contained in the bag is drawn and the ring cap element is disengaged from the neck of the container, if said ring cap element is removed, at least said bag, said pump and said annular support element remain steadily bound to said ring cap element;

wherein said ring cap element comprises a second connection counter-means suitable to cooperate directly with said first connection means of the neck of the container to connect removably together said ring cap element and said neck of the container.

2. A device according to claim 1, wherein the annular support element comprises a centering and positioning portion, projecting downward from the at least one rest wall and suitable to engage with an upper inner or outer portion of the neck of the container.

3. A device according to claim 2, wherein the centering and positioning portion has a limited height H1 and the neck of the container has a height H2, the limited height H1 being equal to or less than 20% of the height H2.

4. A device according to claim 2, wherein the centering and positioning portion has a limited height H1 equal to or less than 10% of a height of the neck of the container.

5. A device according to claim 2, wherein the centering and positioning portion has a limited height H1 equal to or less than 5% of a height of the neck of the container.

6. A device according to claim 1, wherein a maximum diameter of the annular support element is equal to or less than a maximum diameter of the neck of the container.

7. A device according to claim 1, wherein said second connection means comprises at least one tooth projecting from a free outer surface of the annular support element.

8. A device according to claim 7, wherein said second connection means of said annular support element comprises only one continuous circular tooth concentric to said annular support element, or a plurality of teeth arranged along a same circumference concentric to said annular support element.

9. A device according to claim 7, wherein said second connection means are provided on an outer surface of the annular support element.

10. A device according to claim 9, wherein the annular support element has at least one contact surface suitable to come into contact with the neck of the container, said at least one contact surface having the at least one passage channel.

11. A device according to claim 1, further comprising at least one passage channel for air flow between an outer side of the container and a gap existing between an inner surface of the cavity of the container and an outer surface of the bag housed in said cavity.

12. A device according to claim 1, wherein the ring cap element is a single ring cap element.

13. A device according to claim 1, wherein the annular support element comprises:

at least one substantially flat wall, having a lower surface suitable to rest on a free upper edge of the neck of the container and an upper surface on which at least one portion of the flange of the bag rests, wherein a width of said lower surface is substantially the same as a width of said free upper edge of the neck of the container.

14. A device according to claim 1, wherein the annular support element comprises:

at least one substantially flat wall, with a substantially horizontal development, having a lower surface suitable to rest on a free upper edge of the neck of the container and an upper surface on which at least one portion of the flange of the bag rests, wherein a vertical wall develops from said at least one substantially flat wall perpendicularly upwards and the second connection means is suitable to cooperate with the first connection counter-means provided in said ring cap element to steadily bind together said annular support element and said ring cap element, wherein the second connection means projects from a face turned toward the outside of said vertical wall.

15. A device according to claim 1, wherein an overall height of the annular support element is lower than at least 50% of an overall height of the neck of the container.

16. A device according to claim 1, wherein an overall height of the annular support element is lower than 30% of a height of the neck of the container.

17. A device according to claim 1, wherein an overall height of the annular support element is lower than 20% of an overall height of the neck of the container.

* * * * *